US005259434A

United States Patent [19]

Federhen

[11] Patent Number: 5,259,434

[45] Date of Patent: Nov. 9, 1993

[54] METHOD OF REGENERATING USED FOUNDRY SANDS

[75] Inventor: Bernd Federhen, Siegen, Fed. Rep. of Germany

[73] Assignee: Alb. Klein GmbH & Co. KG, Niederfischbach, Fed. Rep. of Germany

[21] Appl. No.: 838,831

[22] Filed: Feb. 21, 1992

[30] Foreign Application Priority Data

Mar. 27, 1991 [DE] Fed. Rep. of Germany ..... 4109993

[51] Int. Cl.[5] ..... B22D 29/00; B22C 5/00

[52] U.S. Cl. ..... 164/5; 241/DIG. 10

[58] Field of Search ..... 164/5; 241/DIG. 10

[56] References Cited

U.S. PATENT DOCUMENTS

| | | | |
|---|---|---|---|
| 3,646,987 | 3/1972 | Schumacher | 164/5 |
| 3,738,415 | 6/1973 | Planten | 164/5 |
| 3,857,201 | 12/1974 | Jacob | 241/DIG. 10 X |

FOREIGN PATENT DOCUMENTS

| | | | |
|---|---|---|---|
| 52-3525 | 1/1977 | Japan | 164/5 |
| 56-4339 | 1/1981 | Japan | 164/5 |
| 1458061 | 2/1989 | U.S.S.R. | 164/5 |

*Primary Examiner*—J. Reed Batten, Jr.
*Attorney, Agent, or Firm*—Bachman & LaPointe

[57] ABSTRACT

In a method of regenerating feed material of coated grains with an irregular surface, in particular used foundry sands coated with a casing of binder or the like, the casing is opened up by friction, wherein the sand to be regenerated is brought into rubbing contact with a granular scouring agent, the grain size of which is substantially smaller than that of the sand.

12 Claims, No Drawings

METHOD OF REGENERATING USED FOUNDRY SANDS

BACKGROUND OF THE INVENTION

The invention relates to a method of regenerating feed material of coated grains with an irregular surface, in particular used foundry sands which are covered with a sheath or casing of binder or the like, wherein the sheath or casing is opened up by friction.

The various stages involved in the processing of foundry sands are to be found for example in Giessereilexikon, Berlin 1980[11], pages 675 to 681. An essential aspect in that respect is in particular the regeneration of old sands in order to be able to re-use same to a very substantial extent after a casting operation, in order to save on new sand and to reduce the amounts dumped. For that purpose it is necessary inter alia for the individual grains of sand to be freed from the binders or like impurities which enclose the grains of sand as a sheath or envelope thereon, for which purpose in particular frictional or impact forces are used; the grain surface is cleaned by impingement against a surface or by means of friction by sand grain material. In that situation the binder sheaths which cling to the surface of the grain are removed predominantly by impact or friction, depending on the nature of the method involved.

Thus, for example, German patent specification No 2 408 981 proposes that foundry sand is accelerated by rotation and driven at high speed against a bed of bulk material which serves as an impingement cushion; the grains are broken up and cleaned, under the effect of centrifugal force, due to friction in the bulk material bed. Sand cleaning with a centrifugal wheel and inclinedly disposed impingement plates is disclosed in German laid-open application (DE-OS) No 22 02 311.

German laid-open application (DE-OS) No 24 48 333 provides that the sand is accelerated by means of a pneumatic device against an impingement wall which; for example, extends in a hood-like configuration over a vertical, inclined or horizontal sand guide pipe, at a spacing relative thereto. German patent specification No 2 519 135 also describes a cleaning installation for impact cleaning of granular material by means of a nozzle which is connected to a gas flow source, opposite an impact surface.

German patent specification No 2 233 111 describes a pneumatic regeneration method in which used foundry sand, possibly with new sand mixed therewith, is flung up against an impact bell member or the like, by compressed air. When impact occurs, the binder layers which encase the individual quartz grains split open and the quartz grain can then freshly accept a casing of binder thereon. Quartz grains may suffer damage in that treatment and then occur as dust.

In the case of the methods which provide for acceleration by means of air nozzles, the recommendation is that the air flow should be kept turbulent and that optionally, in addition to a primary flow of sand, there should be a similar secondary flow of sand so that the scouring effect is increased.

Microscopic examination has shown that the convex parts of grains of sand which are treated in that way are admittedly cleaned, but considerable residues of binder still remain clinging in the concave zones. When impact loading occurs, the binder sheathing is not completely detached from the grain but remains clinging thereto precisely in the depressions in which it is relatively firmly and almost form-lockingly engaged; because of their similar size, the grains of sand surrounding same are incapable of penetrating into those depressions and removing the residual binder therein by friction.

SUMMARY OF THE INVENTION

In consideration of that state of the art, the inventor set himself the aim of providing a method with an enhanced regeneration effect, wherein binder residues disposed even in concave regions of the grains of sand are as far as possible removed or at least reduced.

That object is attained herein. There is provided a method of regenerating feed material of coated grains with an irregular surface, in particular used foundry sands which are covered with a sheath or casing of binder or the like, wherein the sheath or casing is opened up by friction, characterized in that the sand to be regenerated is brought into rubbing contact with a granular scouring agent, the grain size of which is substantially smaller than that of the sand.

DETAILED DESCRIPTION OF THE PREFERRED EMBODIMENTS

The inventor makes use of the notion that the dust which occurs in the processing zone is not sucked away and removed from the system, as occurs in the state of the art, but is at least partially used for breaking up and processing the sand to be cleaned; in accordance with the invention the sand is treated with a granular scouring agent, the grain size of which is substantially smaller than the grain size of the sand to be cleaned. Preferably the quartz component of the dust which is produced by the sand treatment is to be separated off, recycled and used, for that purpose. However the scouring agent may also be a fine-grain substance of quartz, iron or the like.

In order to indicate an order of magnitude of the sand relationships, with a quartz sand of the "Frechen" type, bearing the designation F 32, with a mean grain size of 0.23 mm, the predetermined grain size of the so-called scouring agent is at most 0.125 mm, while with sand designation F 34 (0.20 mm), it is 0.09. An overview of the sands can be found in Giessereilexikon (see above), pages 281, 282. The upper grain size limit for the so-called scouring agent preferably corresponds to about 50% of the mean grain size of the sand to be regenerated.

The scouring action at the sand grain surface is achieved by virtue of the scouring agent, relative to the sand, involving a velocity which is different in respect of value and/or direction, and thus impinging on the sand grain surface; it then penetrates even into the concave locations of the grain of sand.

Per se known means such as centrifugal plates, air jets, agitators or the like can be used for the acceleration effect. The treatment may be effected for example in a rotary field, a fluidized bed, or in ducts, in counter-flow or co-flow relationships, and the flows of material may also cross each other.

As a particularly desirable consideration, it has been found that both methods which operate in a batch-wise manner and also continuous-flow methods are suitable for the cleaning operation according to the invention.

It is advantageous, from the dust which occurs in the treatment operation, to separate the predominantly sharp-edged, heavier quartz particles from the softer and lighter binder residues and to use them for treatment of the sand grain surface, whereas the other components of the dust are separated off.

Finally it should be pointed out that the sand may also be heated or cooled for embrittlement and/or drying of the binder sheaths clinging thereto.

I claim:

1. A method of regenerating feed material of used foundry sand having an irregular surface and comprising grains which are covered with a sheath or casing, which comprises: providing feed material to be regenerated of used foundry sand having an irregular surface and comprising grains which are covered with a sheath or casing; bringing the sand to be regenerated into rubbing contact with a granular scouring agent, the grain size of which is substantially smaller than that of the sand, wherein the granular scouring agent at least partially was separated from the feed material and recycled into said rubbing contact.

2. A method according to claim 1 wherein a fine-grain component from a first treatment stage in respect of sand to be regenerated is used as the scouring agent.

3. A method according to claim 1 wherein the scouring agent comprises fine-grain, friable-condition material selected from the group consisting of quartz and iron.

4. A method according to claim 1 wherein the scouring agent is moved past the particles of sand at a different speed relative to the sand.

5. A method according to claim 4 wherein said scouring particles are moved at a higher speed relative to moving sand.

6. A method according to claim 1 wherein the scouring agent is moved past the particles of sand to be processed in counter-flow relationship with respect thereto.

7. A method according to claim 1 wherein the scouring agent is moved past the particles of sand to be processed transversely to the direction of flow of the sand to be processed.

8. A method according to claim 2 wherein said first treatment stage forms a fine-grain dust including softer and lighter dust-like impurities, said softer and lighter dust-like impurities are separated from the fine-grain dust, and the softer and lighter dust-like impurities are used for the treatment of the sand to be regenerated.

9. A method according to claim 1 wherein the upper grain size limit of the scouring agent approximately corresponds to half the mean grain size of the foundry sand to be regenerated.

10. A method according to claim 1 wherein grains of sand to be regenerated are heated with a covering sheath of binder thereon.

11. A method according to claim 1 wherein grains of sand to be regenerated are cooled with a covering sheath of binder thereon.

12. A method according to claim 1 wherein said scouring agent has a maximum grain size of 0.125 mm.

* * * * *